United States Patent [19]

Siems

[11] Patent Number: 4,894,759

[45] Date of Patent: Jan. 16, 1990

[54] PRE-WIRED UNITARY SUPPORT ASSEMBLY FOR FLOODLIGHTS

[76] Inventor: Steven L. Siems, 1491 S. W. 21st Ave., Fort Lauderdale, Fla. 33312

[21] Appl. No.: 298,700

[22] Filed: Jan. 19, 1989

[51] Int. Cl.[4] ..... F21S 1/10

[52] U.S. Cl. ..... 362/250; 362/431; 174/45 R; 361/332; 361/428

[58] Field of Search ..... 362/249, 250, 382, 431; 174/45 R; 361/428, 429, 332

[56] References Cited

U.S. PATENT DOCUMENTS

| | | | |
|---|---|---|---|
| 1,972,187 | 9/1934 | Farnam | 174/45 R |
| 1,974,080 | 9/1934 | Marker et al. | 174/45 R |
| 3,034,098 | 5/1962 | Clasen | 362/250 |
| 3,653,622 | 4/1972 | Farmer | 174/45 R |
| 4,190,881 | 2/1980 | Drost et al. | 362/250 |
| 4,363,084 | 12/1982 | Dimiceu | 362/250 |
| 4,450,507 | 5/1984 | Gordin | 362/250 |
| 4,523,256 | 6/1985 | Small | 362/250 |

*Primary Examiner*—Ira S. Lazarus
*Assistant Examiner*—Richard R. Cole
*Attorney, Agent, or Firm*—Oltman and Flynn

[57] ABSTRACT

A pre-wired unitary support assembly for mounting floodlights on a pole. The support assembly has a vertically elongated rigid channel that is to be bolted to the pole, a junction box on the front of the channel, a hollow cross arm on the front of the channel above the junction box, electrical wiring extending from inside the junction box up into the cross arm through a tube assembly between them and out along the inside of the cross arm to wiring fittings on the front where insulated cables for the corresponding floodlights extend into the cross arm, adapters on the top of the cross arm near the wiring fittings for the attachment of the usual support yokes for the floodlights, removable access plates on the bottom of the cross arm adjacent the wiring fittings on the front, and a protective wiring sleeve extending down from the junction box.

13 Claims, 2 Drawing Sheets

PRE-WIRED UNITARY SUPPORT ASSEMBLY FOR FLOODLIGHTS

SUMMARY OF THE INVENTION

This invention relates to a pre-wired unitary support assembly for mounting floodlights on a pole.

A principal object of this invention is to provide a novel pre-wired support assembly which simplifies the installation of floodlights on a support pole, such as at an athletic field or stadium.

Another object of this invention is to provide such a support assembly which can be used with a variety of floodlight fixtures pre-aimed at the factory and requiring little or no adjustment at the installation site.

Preferably, the present invention comprises a hollow cross arm on which the floodlights are to be mounted and having an electrical junction box located centrally below the cross arm, a wiring tube assembly extending up from the junction box to the cross arm, a wiring sleeve extending down from the junction box, a vertically elongated back member extending behind the cross arm and the junction box and attachable to a pole, and wiring extending from the junction box up through the wiring tube and along the inside of the cross arm to where the floodlights are to be mounted on the cross arm. The cross arm has removable access plates at each floodlight position to permit the wires therein coming from the junction box to be connected to the wires of the external cable for the floodlight. Attached to the top of the cross arm at each floodlight location is an adapter to which the usual support yoke of the floodlight is attached by a single bolt-and-nut assembly.

Further objects and advantages of this invention will be apparent from the following detailed description of a presently preferred embodiment which is illustrated schematically in the accompanying drawings.

Figure 1:
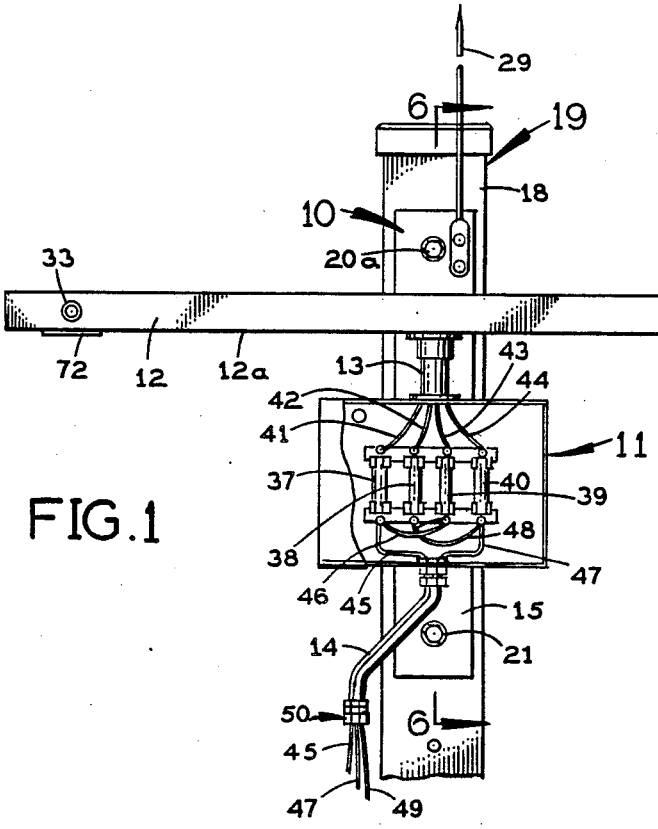
FIG. 1 is a front elevation of the present invention with one part broken open and mounted on a pole and with the wiring removed from the pole.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

In broad outline, the present invention comprises a vertically elongated back member in the form of a channel 10 (FIGS. 1,2 and 3), a junction box 11 on the front of the channel, a horizontally elongated, hollow, cross-arm 12 attached to the front of channel 10 above the junction box 11 and extending on opposite sides of both the channel and the junction box, a tube assembly 13 extending between the top of the junction box 11 and the bottom of cross arm 12 and receiving electrical wiring, insulated electrical wires 41,42,43 and 44 extending from the junction box 11 up through the tube assembly and along the inside of cross arm 12 to the locations of floodlights thereon, and a wiring sleeve 14 extending down from junction box 11. Preferably, the present assembly also includes mounting adapters A (FIGS. 4 and 8) attached to the top of the hollow cross-arm 12 at the floodlight locations.

Figure 2:
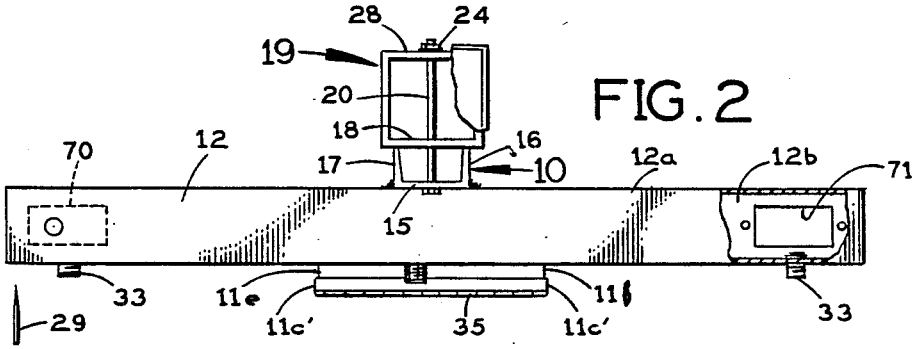
FIG. 2 is a top plan view of the FIG. 1 assembly, broken open near the right end.
Figure 3:
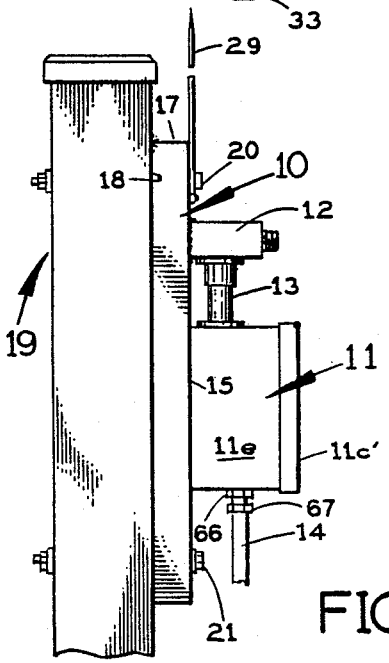
FIG. 3 is a side elevation taken from the left side of FIG. 1.

As best seen in FIGS. 2 and 3, the vertically elongated channel 10 has a flat front wall 15 and opposite end legs 16 and 17 extending rearward from the flat front wall 15 into engagement with the flat front wall 18 of a vertically elongated, hollow pole 19 of rectangular cross-section. Upper and lower bolts 20 and 21 (FIGS. 1 and 6) extend through the pole and through the front wall 15 of channel 10. These bolts have enlarged heads 20*a* and 21*a* (FIG. 6) on their front ends which hold corresponding flat annular washers 22 and 23 against the outer face of the front wall 15 of channel 10. Respective nuts 24 and 25 on the threaded back ends of bolts 20 and 21 hold similar washers 26 and 27 against the back wall 28 of pole 19.

As an optional feature, a lightning rod 29 is rigidly attached to the front wall 15 of channel 10 on one side of the head 20*a* of the upper bolt, as shown in FIG. 1. This attachment of the lightning rod is through a metal-to-metal connection and both the channel 10 and the pole 19 are of metal, so if lightning strikes the lightning rod 29 the current surge will be conducted to the ground through channel 10 and pole 19. Alternatively, a lightning conductor may be cast in the pole 19 and connected conductively to the hollow cross arm 12.

Figure 5:
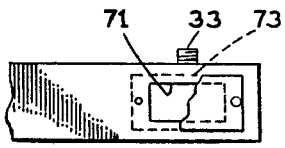
FIG. 5 is a fragmentary bottom plan view of the cross arm taken from the line 5—5 in FIG. 1.
Figure 6:
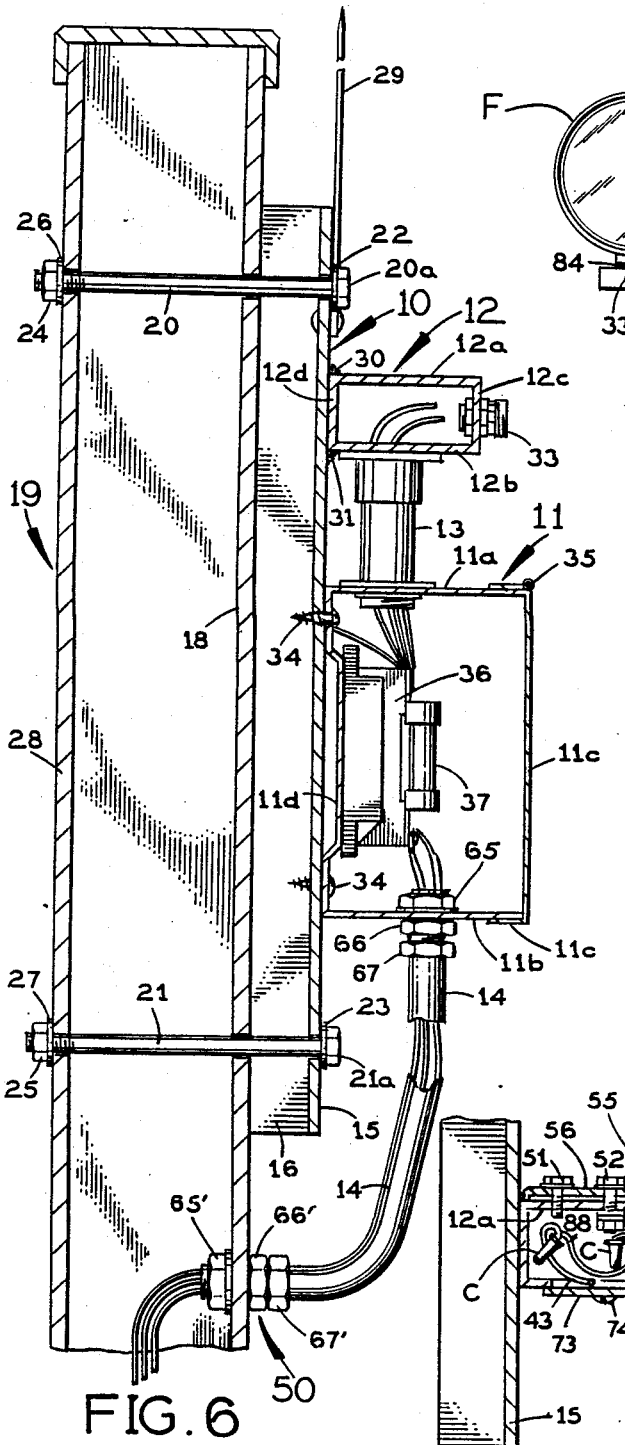
FIG. 6 is a vertical cross-section taken along the line 6—6 in FIG. 1 but with the wiring extending inside the pole.
Figure 7:
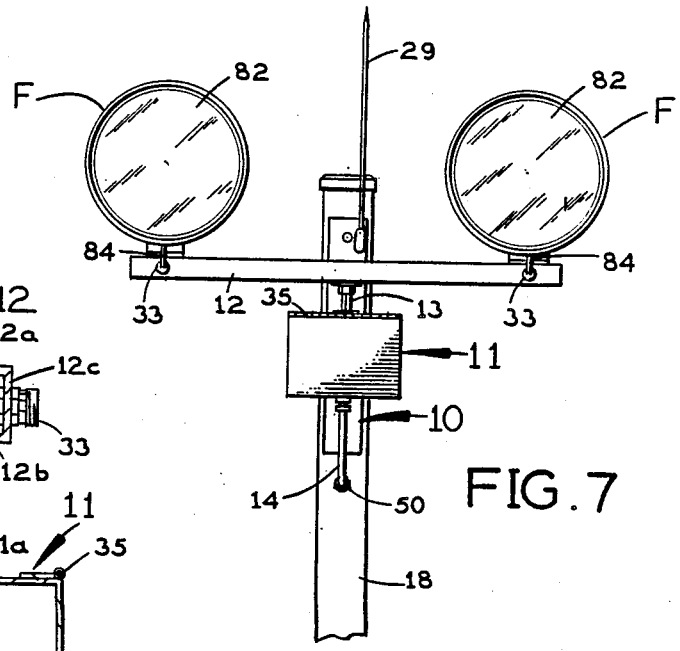
FIG. 7 is a front elevation of the present invention mounted on a pole and supporting two floodlights.
Figure 8:
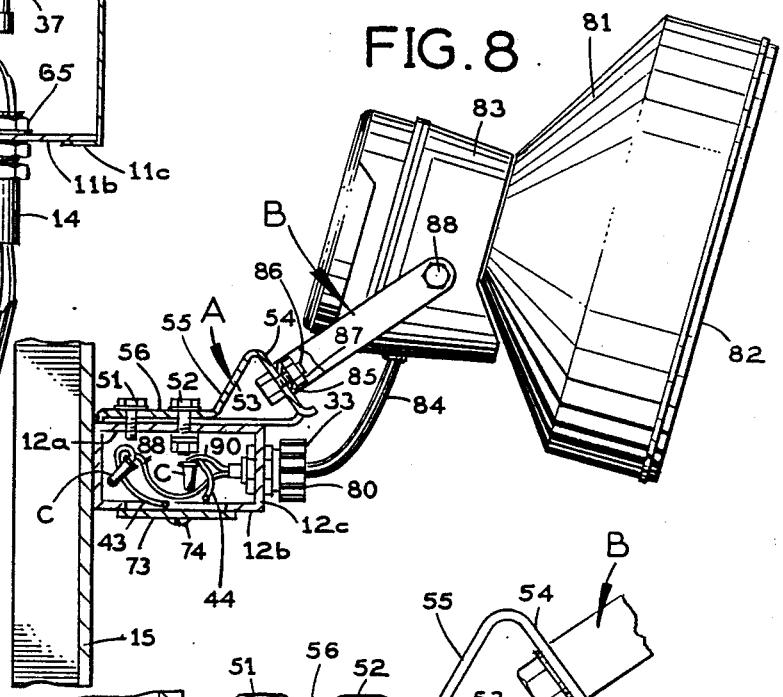
FIG. 8 shows part of the present invention in vertical cross-section and supporting a floodlight, its mounting bracket and the adjustable adapter of FIG. 4.

As best seen in FIG. 6, the hollow cross arm 12 is of a rectangular cross-section with a flat top wall 12*a*, a flat bottom wall 12*b*, a flat front wall 12*c* and a flat back wall 12*d*. The back wall 12*d* of the cross arm is welded along the top and bottom to the front wall 15 of channel 10, as shown at 30 and 31. The front wall 12*c* of the cross arm has two laterally spaced openings 32 (FIG. 9) where tubular wiring fittings 33 are mounted. As shown in FIG. 7, these fittings are located close to the outer ends of cross arm 12 substantially centrally below the respective floodlights F. The bottom wall 12*b* of the cross arm has a single central opening which opens down into the tube assembly 13 that extends down through the top wall 11*a* of junction box 11. Also, the bottom wall 12*b* of cross arm 12 has a pair of rectangular openings 70 and 71 (FIGS. 2 and 5) which are covered by access plates 72 and 73 (FIGS. 1 and 5) attached to the bottom wall 12*b* by screws 74 (FIGS. 8 and 9).

Figure 9:
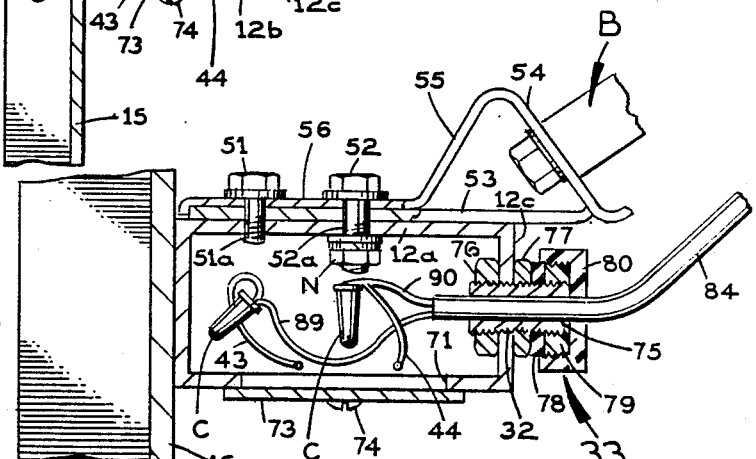
FIG. 9 is an enlarged fragmentary cross-section taken at the same location as FIG. 8.

As shown in FIG. 9, the wiring fitting 33 at each front opening 32 in the hollow cross arm comprises an externally screw-threaded, hollow sleeve 75 threadedly received in the opening 32, an inside nut 76 threadedly engaging the sleeve 75 and abutting against the inside face of the front wall 12*c* of cross arm 12, an outside nut 77 threadedly engaging the sleeve 75 and abutting against the outside face of front wall 12*c*, an annular washer 78 of rubber-like material encircling the sleeve 75 in front of nut 77, a nut 79 threaded onto the front end of sleeve 75 in front of washer 78 and having a screw-threaded outer periphery, and a flanged cap 80 threaded onto nut 79 and holding the washer 78 compressed to prevent moisture from getting into the hollow cross arm 12.

Figure 4:
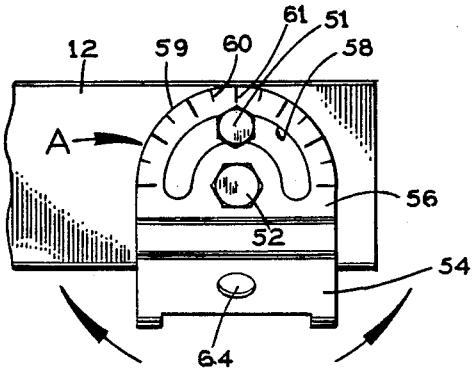
FIG. 4 is a top plan view of a known type of adjustable adapter which preferably is part of the present assembly and is used to mount a floodlight on the cross-arm of the present assembly.

As shown in FIG. 7, the floodlights F are mounted on top of the hollow cross arm 12 at the wiring fittings 33. FIGS. 8 and 9 show one of the floodlight mounting arrangements in detail. The other is identical. This mounting arrangement includes an adapter A, as shown in FIG. 4, which may be a General Electric Company model CAA-001 cross arm adapter. As best seen in FIG. 9, this adapter has a flat bottom wall 53 overlying the top wall 12*a* of the cross arm, a front wall 54 which is inclined upward and rearward from the front end of bottom wall 53, a rear wall 55 which is inclined downward and rearward from the top of the front wall 54, and a flat upper wall 56 extending behind the rear wall 55 and directly overlying the bottom wall 53. The bottom wall 53 and the upper wall 56 of adapter A have aligned openings which slidably receive mounting bolts 51 and 52. The top wall 12*a* of the hollow arm 12 has a screw-threaded opening 51*a* which threadedly receives bolt 51 and an opening 52*a* which slidably receives bolt 52. A nut N is threadedly attached to the lower end of bolt 52 inside the hollow cross arm 12 and it clamps a pair of lock washers up against the top wall 12*a* of this cross arm.

As shown in FIG. 4, the upper wall 56 of the adapter is formed with an arcuate slot 58 which extends in a semi-circle behind the front mounting bolt 52. The axis of bolt 52 is the center of this semi-circle. Behind its slot 58, the adapter presents a semi-circular back edge 57 where a graduated scale 60 is located, calibrated in degrees from a center point 61. The back mounting bolt 51 extends down loosely through the arcuate slot 58, and the head of this bolt overlies the upper wall 56 of adapter A in front of and behind this slot. After loosening bolts 51 and 52, the adapter A can be turned either way to the desired angle with respect to the cross arm 12, and then these bolts can be tightened to clamp the adapter tightly to the cross arm.

The front wall 54 of adapter A has a circular opening 64 about half-way up.

Each of the floodlights is of known design with a parabolic reflector 81 (FIG. 8) and a lens assembly 82 attached to a housing 83 for wiring and ballast. The floodlight may be a General Electric "POWR-SPOT" floodlight or a SPORTSLITER floodlight of Hubbell Incorporated. A rubber-covered wiring cable 84 capable of withstanding the ravages of the weather extends down from floodlight housing 83 through the respective wiring fitting 33 into the interior of the hollow cross arm 12 directly above the removable access plate 72 or 73.

The housing 83 is connected to a bracket B in the form of a rigid yoke having opposite legs extending up on opposite sides of housing 83 from a flat connecting segment 85 (FIG. 8) which has an opening that registers with the opening 64 in the front wall 54 of adapter A. A bolt and nut assembly 86,87 clamps this segment of the yoke against the adapter. Housing 83 is pivotally adjustable on a horizontal axis at the upper end of the yoke where clamping nuts 88 are provided to clamp housing 83 at any selected position angularly with respect to the yoke.

The junction box 11 (FIG. 6) has a flat bottom wall 11*b* extending parallel to its top wall 11*a*, and a flat back wall 11*d* extending between its bottom and top walls and attached to the front wall 15 of channel 10 by sheet metal screws 34. The junction box has a front cover 11*c* attached to the top wall 11*a* by a piano hinge 35 and having a transverse lip 11*c'* along its periphery that fits closely outside the top and bottom walls 11*a* and 11*b* and the opposite end walls 11*e* and 11*f* (FIG. 2) of the junction box when the cover 11*c* is closed.

Inside the junction box 11 its back wall 11*d* supports a dielectric block 36 (FIG. 6) on the front of which are positioned the holders for four electrical fuses 37,38,39 and 40 (FIG. 1). The upper terminals of fuses 37 and 38 are connected conductively to insulated wires 41 and 42 which pass up through tube assembly 13 and along the interior of hollow cross arm 12 to a position above the removable access plate 72 near the left end of the cross arm. The upper terminals of fuses 39 and 40 are connected conductively to insulated wires 43 and 44 which pass up through tube assembly 13 and along the interior of cross arm 12 to a position above the access plate 73 near the right end of the cross arm. One input power wire 45 is connected directly to the lower teminal of fuse 37 and by a jumper wire 46 to the lower terminal of fuse 39. The other input power wire 47 is connected directly to the lower terminal of fuse 40 and by a jumper wire 48 to the lower terminal of fuse 38.

The wiring sleeve 14 passes the power supply wires 45 and 47 and a ground conductor 49 from an annular fitting 50 on the lower end of this sleeve which is releasably attachable to the front 18 of the hollow pole 19 at an opening therein in a water-tight manner. The power supply and ground wires extend down through the hollow interior of the pole. As shown in FIG. 6, the upper end of wiring sleeve 14 is screw-threaded and is attached in fluid-tight fashion to the bottom wall 11*b* of junction box 11 by nuts 65,66 and 67. The fitting 50 on the lower end of wiring sleeve 14 comprises similarly arranged nuts 65',66' and 67'.

As shown in FIG. 9, the wires 43 and 44 coming from the upper terminals of fuses 39 and 40 in junction box 11 are connected to the wires 89 and 90 in the floodlight wiring cable 84 by wiring connectors C of known design.

The unitary support assembly of the present invention includes the hollow cross arm 12, junction box 11, wiring tube 13, wiring sleeve 14, the channel 10 for mounting them on a pole and the wires 41,42,43 and 44 running along the inside of the hollow cross arm 12 from the fuses 37,38,39 and 40 in junction box 11. Preferably, the assembly also includes the adapters A attached to the cross-arm 12 and angularly adjusted thereon so that the floodlights are pre-aimed, in effect, by the positions of the adapters A, as established at the factory where the present unitary support assembly is assembled. The installation contractor need only remove the access plates 72 and 73 to have access to the interior of cross arm 12 where these wires are to be connected to the wires 89 and 90 of the respective floodlight wiring cables 84. The wiring cables 84 may come with the floodlights or may be purchased separately. The contractor mounts the floodlights F on the adapters A by means of the yoke-shaped floodlight brackets B. The contractor need only attach the brackets B to the adapters A by a single nut-and-bolt assembly 86,87 at each and connect the wires 89,90 of the floodlight's wiring cable 84 to the wires (e.g., 41,42,43,44) running along the inside of the hollow cross arm 12. It is also the installation contractor's responsibility to run the power supply and ground wires 45,47 and 49 up through the pole 19 and through the wiring sleeve 14 of the present support assembly to the lower terminals of fuses 37,38,39 and 40 and the ground terminal inside junction box 11. It is a great convenience to the contractor to have the floodlight support assembly delivered to the installation site pre-assembled structurally and pre-wired from the junction box 11 to the wiring fittings 33 on the front of the cross arm. Also, it is convenient to have the floodlights effectively pre-aimed by the factory-installed positioning of the adapters A on the cross-arm 12 so that the installation contractor is relieved of this responsibility.

It is to be understood that the pre-wired support assembly of the present invention may be designed for three, four, five or more floodlights instead of the two shown in the drawings. Also, the lamp ballasts may be located in the junction box with the fuses or in a separate junction box instead of being in the housings directly behind the floodlights, as shown.

I claim:

1. A pre-wired unitary support assembly for mounting floodlights on a pole comprising:

a vertically elongated back member attachable to the pole;

an electrical junction box rigidly affixed to said back member, said junction box having a bottom opening and a top opening therein;

a tubular wiring sleeve extending down from said bottom opening in the junction box;

a horizontally elongated hollow cross arm rigidly affixed to said back member above said junction box, said cross arm having a bottom opening therein above said top opening in the junction box, said cross arm having laterally spaced openings therein, and wiring fittings on said cross arm at said laterally spaced openings therein;

tube means attached at its lower end to said junction box and at its upper end to said cross arm, said tube means extending from said top opening in the junction box up to said bottom opening in the cross arm;

and electrical wiring extending from behind said wiring fittings on said cross arm along the inside of said cross arm to said bottom opening therein and down through said tube means and through said top opening in the junction box into the inside of the junction box.

2. An assembly according to claim 1 and further comprising:

an adapter attached to the top of said cross arm above each of said wiring fittings, each said adapter having a rearwardly and upwardly inclined front wall with a bolt hole therein for the attachment of a floodlight support yoke to the adapter to position the floodlight in front of said adapter.

3. An assembly according to claim 1 wherein each of said wiring fittings on said cross arm comprises:

an externally screw-threaded sleeve extending through the corresponding opening in the cross arm;

an inside nut threadedly engaging said screw-threaded sleeve behind the corresponding opening in the cross arm;

an outside nut threadedly engaging said screw-threaded sleeve in front of the corresponding opening in the cross arm;

said outside and inside nuts engaging said cross arm to hold said screw-threaded sleeve extending through the corresponding opening in the cross arm;

a sealing element on said screw-threaded sleeve in front of said outside nut;

and means for holding said sealing element compressed to prevent the entry of water into said cross arm at the corresponding opening therein.

4. An assembly according to claim 3 wherein said means for holding comprises:

an additional nut threadedly engaging said screw-threaded sleeve in front of said sealing element, said additional nut being externally screw-threaded;

and a flanged annular cap threadedly encircling said additional nut.

5. An assembly according to claim 4 and further comprising:

an adapter attached to the top of said cross arm above each of said wiring fittings, each said adapter having a rearwardly and upwardly inclined front wall with a bolt hole therein for the attachment of a floodlight support yoke to the adapter to position the floodlight in front of said adapter.

6. A support assembly according to claim 1 wherein said hollow cross arm has a respective bottom opening therein behind each of said laterally spaced openings and a respective access plate covering each said bottom opening, each of said access plates being removably attached to said cross arm and enabling access to the interior of the cross arm for making wiring connections between said wiring which extends to the junction box and a cable extending from the respective floodlight through the corresponding wiring fitting on the cross arm.

7. An assembly according to claim 6 and further comprising:

an adapter attached to the top of said cross arm above each of said wiring fittings, each said adapter having a rearwardly and upwardly inclined front wall with a bolt hole therein for the attachment of a floodlight support yoke to the adapter to position the floodlight in front of said adapter.

8. An assembly according to claim 1 wherein each of said wiring fittings on said cross arm comprises:

an externally screw-threaded sleeve extending through the corresponding opening in the cross arm for passing a cable extending from the floodlight;

an inside nut threadedly engaging said screw-threaded sleeve behind the corresponding opening in the cross arm;

an outside nut threadedly engaging said screw-threaded sleeve in front of the corresponding opening in the cross arm;

said outside and inside nuts engaging said cross arm to hold said screw-threaded sleeve extending through the corresponding opening in the cross arm;

a sealing element on said screw-threaded sleeve in front of said outside nut;

and means for holding said sealing element compressed to prevent the entry of water into said cross arm at the corresponding opening therein.

9. An assembly according to claim 8 wherein said means for holding comprises:

an additional nut threadedly engaging said screw-threaded sleeve in front of said sealing element, said additional nut being externally screw-threaded;

and a flanged annular cap threadedly encircling said additional nut.

10. An assembly according to claim 9 and further comprising:

an adapter attached to the top of said cross arm above each of said wiring fittings, each said adapter having a rearwardly and upwardly inclined front wall with a bolt hole therein for the attachment of a floodlight support yoke to the adapter to position the floodlight in front of said adapter.

11. A support assembly according to claim 1 wherein said wiring sleeve has an annular fitting on its lower end for releasable attachment to the pole at an opening in the pole to pass wiring from inside the pole up through said wiring sleeve and into said junction box.

12. A support assembly according to claim 11 wherein said hollow cross arm has a respective bottom opening therein behind each of said laterally spaced openings and a respective access plate covering each said bottom opening, each of said access plates being removably attached to said cross arm and enabling access to the interior of the cross arm for making wiring connections between said wiring which extends through the cross arm to the junction box and a cable extending from the respective floodlight through the corresponding wiring fitting on the cross arm.

13. An assembly according to claim 12 and further comprising:

an adapter attached to the top of said cross arm above each of said wiring fittings, each said adapter having a rearwardly and upwardly inclined front wall with a bolt hole therein for the attachment of a floodlight support yoke to the adapter to position the floodlight in front of said adapter.

* * * * *